US009995127B1

(12) United States Patent
Hice et al.

(10) Patent No.: US 9,995,127 B1
(45) **Date of Patent: *Jun. 12, 2018**

(54) LOW-FREQUENCY PULSING SONIC AND HYDRAULIC MINING METHOD

(71) Applicant: Geodrilling Technologies, Inc., Gold Hill, OR (US)

(72) Inventors: Gilbert Alan Hice, Gold Hill, OR (US); Thomas Joseph Hice, Gold Hill, OR (US)

(73) Assignee: Geodrilling Technologies, Inc., Gold Hill, OR (US)

( * ) Notice: Subject to any disclaimer, the term of this patent is extended or adjusted under 35 U.S.C. 154(b) by 126 days.

This patent is subject to a terminal disclaimer.

(21) Appl. No.: 15/203,342

(22) Filed: Jul. 6, 2016

Related U.S. Application Data

(63) Continuation-in-part of application No. 14/862,122, filed on Sep. 22, 2015.

(51) Int. Cl.

| | |
|---|---|
| ***E21C 45/04*** | (2006.01) |
| ***E21B 43/29*** | (2006.01) |
| ***E21C 37/12*** | (2006.01) |
| ***E21B 7/24*** | (2006.01) |

(Continued)

(52) U.S. Cl.
CPC ..... *E21B 43/29* (2013.01); *E21B 7/18* (2013.01); *E21B 7/24* (2013.01); *E21B 21/065* (2013.01); *E21C 37/12* (2013.01)

(58) Field of Classification Search
CPC . E21B 43/29; E21B 7/18; E21C 45/00; E21C 45/02; E21C 45/04; E21C 37/12
See application file for complete search history.

(56) References Cited

U.S. PATENT DOCUMENTS

| | | | |
|---|---|---|---|
| 73,160 | A | 1/1868 | Block |
| 157,192 | A | 11/1874 | Campfield |
| 1,588,102 | A | 6/1926 | Goody |

(Continued)

OTHER PUBLICATIONS

Anthony Simpson, Positive Preliminary Evaluation of Borehole Mining at the Hansen Uranium Deposit, Feb. 13, 2012, pp. 1-10.

(Continued)

*Primary Examiner* — John J Kreck
(74) *Attorney, Agent, or Firm* — James W. Pravel; Intella IP

(57) ABSTRACT

Enhanced method for borehole mining comprising: drilling a borehole using a low-frequency pulsing sonic, hydraulic mining system including a pulsed jet assembly; inserting casing into the borehole above target deposit depth; inserting and rotating assembly into the casing with a sub-coupling and a shoe rock bit positioned below the casing; pumping fluid into the borehole; evaluating slurry at surface; fracturing and disaggregating materials at target deposit with pulsing jets from the sub-coupling and rock bit causing light slurry to flow upwardly to the annulus between the borehole casing and the downhole assembly, then upwardly through the annulus to the surface of the borehole thereby causing heavy slurry to concentrate in a sump, located below the pulse jet rock bit; continuing to form cavity at target location; removing pulsed jet assembly from borehole; running core barrel to extract heavy slurry from sump; analyzing slurry to determine whether to continue with operation.

8 Claims, 10 Drawing Sheets

(51) Int. Cl.
*E21B 7/18* (2006.01)
*E21B 21/06* (2006.01)

(56) References Cited

U.S. PATENT DOCUMENTS

| | | | | |
|---|---|---|---|---|
| 2,972,380 | A | 2/1961 | Bodine | |
| 3,747,696 | A | 7/1973 | Wenneborg et al. | |
| 3,797,590 | A | 3/1974 | Archibald et al. | |
| 3,897,836 | A | 8/1975 | Hall et al. | |
| 4,319,784 | A | 3/1982 | Claringbull | |
| 4,366,988 | A * | 1/1983 | Bodine | B01D 11/0261 166/177.1 |
| 4,440,450 | A | 4/1984 | Coakley | |
| 4,536,035 | A | 8/1985 | Huffman et al. | |
| 4,728,152 | A * | 3/1988 | Pike | E21B 7/20 166/175 |
| 6,308,835 | B1 | 10/2001 | Wade | |
| 7,066,250 | B2 * | 6/2006 | Webb | E21B 28/00 166/177.6 |
| 8,006,915 | B2 | 8/2011 | Vjay et al. | |
| 8,356,677 | B2 | 1/2013 | Drivdahl et al. | |
| 2012/0255782 | A1 | 10/2012 | Smith et al. | |
| 2013/0106166 | A1 * | 5/2013 | Gilmore | E21B 43/292 299/17 |
| 2016/0084083 | A1 * | 3/2016 | Hice | E21B 7/18 299/1.05 |

OTHER PUBLICATIONS

Randy Clarkson, Placer Gold Recovery Research Final Summary, Dec. 1990, pp. 1-5.
S. Dehkhoda, Experimental Study of Rock Breakage with Pulsed Water-Jet, Oct. 14-16, 2014, pp. 1-7.
J. Foldyna et al., Enhancing of Water Jet Effects by Pulsations, 2007, pp. 1-4 .
Josef Foldyna, Transmission of Acoustic Waves, 2007, pp. 1-3.
Cherie Geiger, Summary of the Remediation Technologies Development Forum Permeable Reactive Barriers Action Team Meeting, Jun. 12, 2001, pp. 1-3.
Sonic Drill Corporation, How the "Sonic" Drill Works, Aug. 12, 2015, p. 1.
JRG/JT Models for Pumping Liquids, 2016 Online Catalog, pp. 1-2.
S.S. Kivilis, Discharge Coefficients of Diaphragms and Nozzles, Jun. 1959, vol. 2, Issue 6, pp. 469-473.
Landis, High Pressure Jetting, Nov. 1997, pp. 13-24.
P.D. Lohn et al., Improved Mineral Excavation Nozzle Design Study, Jul. 1975-Mar. 1976, pp. 1-104.
Richard C. Landis, Development of an Integrated in-situ Remediation Technology, Nov. 1997, pp. 1-4.
Eugene B. Nebeker et al., Standoff Distance Improvement Using Percussive Jets, May 24-26, 1983, cover page and pp. 28-44.
E.B. Nebeker, Percussive Jets—State-of-the-Art, Aug. 26-28, 1987, pp. 32-45.
Niosh, Prototype Borehole Miner Selectively Extracts Gold from Permafrost, Jul. 1997, pp. 1-2.
George A. Savanick, Hydraulic Mining: Borehole Slurrying, 1992, pp. 1930-1938.
George A. Savanick, Hydraulic Mining Experiments in an Underground Mine in the St. Peter Sandstone, Clayton, Iowa, May 1983, pp. 214-227.
SonicSampDrill, Sonic Drilling, How Does it Work?, Oct. 29, 2012, pp. 1-2.
SonicSampDrill, Sonic Rig Brochure, Dec. 3, 2014, pp. 1-4.
David A. Summers, Considerations in the Comparison of Cavitating and Plain Water Jets, 1983, pp. 178-184.
D.A. Summers, The Use of Waterjets in Mining, May 27, 1993, pp. 280-290.
JRG/JT, Using Jerguson/Jacoby-Tarbox Eductors for Pumping Liquids, May 18, 2016, pp. 1-10.
W.Z. "Ben" Wu et al., Dynamic Characteristics of Waterjets Generated from Oscillating Systems, Aug. 26-28, 1987, pp. 61-72.

* cited by examiner

LOW-FREQUENCY PULSING SONIC AND HYDRAULIC MINING METHOD

CROSS REFERENCE TO RELATED APPLICATIONS

This application is a continuation-in-part of U.S. application Ser. No. 14/862,122, filed Sep. 22, 2015, which claims the benefit of U.S. provisional application Ser. No. 62/071,420, filed Sep. 23, 2014 and each application is incorporated by reference herein in their entirety.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

This invention relates to the field of sonic drilling systems, borehole water jet mining and sonically pulsed water jet mining systems.

BACKGROUND

Sonic Drilling Systems

Sonic drilling systems have been used over the years primarily for borehole coring purposes. The original general sonic coring concept is credited to George Constantinesco in 1910. A sonic drill is a rotary vibratory type drill. A sonic drill looks very much like a conventional air or mud rotary drill rig. The biggest difference is in the drill head, which is slightly larger than a standard rotary head. The head contains the mechanism necessary for rotary motion, as well as an oscillator which causes a high-frequency force of typically between 80-100 Hz and higher to be superimposed on the drill string. The drill bit physically vibrates up and down in addition to being pushed down and rotated. These three combined forces allow drilling to proceed rapidly through most geologic formations including most types of rock.

Minimal fluid circulation in the borehole is usually used with sonic drills while drilling to obtain core samples or to retrieve rod string tools. The material ahead of the sonic drill bit is pressed into the surrounding formation or it is captured in the core barrel and is recovered at the surface through a stable borehole casing as a core sample for analysis. Sonic drills and drilling machines have the disadvantage of a relatively high purchase cost. Efforts over the past fifty some years have resulted in improved reliability and desirability of sonic drilling systems for use in demanding commercial surface drilling and core recovery operations. Sonic drills are currently particularly efficient tools for drilling primarily unconsolidated and some consolidated materials to maximum depths of usually less than 1000 feet for small commercial rig models. As compared to the more commercially used mud or pneumatic rotary drill rigs that incorporate mechanical means of drilling—the sonic drill uses approximately 50% less horsepower, advance in depth in aggregate much faster due to liquefaction of contact material, and produces up to 70% less waste in cuttings while using only small amounts of water for flushing and bit cooling and have relatively no seismic registration to destabilize surrounding ground.

In overburden, the vibratory action causes the surrounding soil particles to fluidize, thereby allowing effortless penetration. In rock, the drill bit causes fractures at the rock face, creating rock dust and small rock particles, which facilitates advancement of the drill bit. Typically, compressed air, drill mud or plain water is used to remove the cuttings from the borehole of the sonic drill system.

The oscillator on a sonic drill rig is normally driven by a hydraulic motor and uses out of balance weights to generate high sinusoidal forces that are transmitted to the drill bit. An air spring is also typically incorporated in order to confine the alternating forces to the drill string.

Some patents disclose mechanisms that produce oscillating waves of energy of vibrational force that are transmitted and propagated into an attached drilling rod string. For example, see U.S. patent Publication Ser. No. 2012/255,782 to Smith et al., U.S. Pat. No. 8,356,577 to Drivdahl et al. and U.S. Pat. No. 7,066,250 to Webb et al. Also see U.S. Pat. No. 3,168,140 to Bodine, which describes an acoustic method for retrieving drilling pipe stuck in a borehole.

Borehole Water Jet Mining Systems

Subsurface mining machines that incorporate water jets have been used to mine desirable subsurface materials, especially coal, for quite some time. Research and development on the use of subsurface mining using water jets was first conducted in both Russia and Germany, followed thereafter by research and development in the United States. Several borehole mining systems were developed external to government funding, one by FMC for the mining of phosphate ore in N.C., and one by Marconoflow and one by the AB Fly Company. The AB Fly Company system was shown to have been capable of mining sand and other material to depths of approximately 120 m at a production rate of up to 1 $m^3$/minute.

Beginning in 1975, the US government funded additional borehole mining experiments. Initial successes led to further field tests carried out initially internally at the Bureau of Mines and then through funding to Flow Industries, Inc. Advantages of the borehole mining technique were an improvement in safety of the extraction of coal and other minerals as well as a reduction in both the time and manpower required to develop mining sites.

The method which evolved was to drill a relatively large hole (approximately 50 cm. in diameter) down from the surface to and through the mineral deposit. Into this borehole, a composite drill stem was lowered made up of three adjacent flow passages within the body of the stem. Through one of the pipes high pressure water was pumped down to two nozzles located on opposite sides of the lower end of the drill stem. As the stem was rotated, using a Kelly of the type common in oil well operations, the ensuing jets cut a circular cavity out into the material on the walls of the borehole. By slowly raising or lowering the string the initial slot could be enlarged both vertically and horizontally until a chamber of up to 7 meters in radius could be created. The jets washed the broken rock down to a sump at the bottom of the drill hole, where a small crushing device would break it into small fragments. At this point the slurry containing the material and the used water was picked up by a jet pump fed by water passed down through the second of the three passages in the drill string in this directed the water and slurry combination up to the third flow channel and thus out of the drill hole to a collection pond on the surface.

Several U.S. Patents exist that disclose borehole water jet systems. For example, U.S. Pat. No. 8,006,915 to Vijay describes a surface ultra-sonic pulsed jetting hydraulic cutting apparatus with a very short but effective range for cutting stone, but which is not suitable for commercial subsurface submerged mining.

U.S. Pat. No. 4,389,071 to Johnson discloses an apparatus and method for pulsed jetting mining (with very short stand-off distance) by generating significant cavitation effects within an associated complex nozzle structure producing a pulsed jetting action that erodes closely associated target minerals. Johnson achieves pulsed jetting using high-pressure, high-frequency pulsed cavitating jets.

U.S. Pat. No. 3,897,836 to Hall et al. describes an apparatus and method for mechanically generating a peripheral pulsed hydraulic jetting action at the drill bit to facilitate drill-bit boring of a borehole.

Continuous-flow jet nozzles, such as the commonly employed Leach & Walker 3-D type nozzle, continue to be used predominantly in industry for hydraulic jetting and washing purposes.

U.S. Pat. No. 4,440,450 to Coakly describes a combined rotating mining apparatus which comprises multiple conduits with internal valves and moving parts that allow changing the function of the apparatus between mining and drilling modes while still in the borehole and having a modulation function of alternating pressure levels to facilitate higher system pressures at the jetting nozzle and eductor when in mining mode. The Coakly apparatus washes cuttings from the base of the tool not allowing concentration of fragmented debris around the base of the tool and ejects them into the jetting stream and mined space. A drilling bit, an eductor and a continuous flow jet are described by Coakly as basically comprising a complex apparatus used for borehole slurry mining.

U.S. Pat. No. 4,319,784 to Claringbull describes an impact driver system that uses wellbore casing with either one or two drill rods freely moving within the casing that have a drilling shoe on the inner pipes. The outer casing is intermittently struck with a piston to provide periodic impulses to advance the casing as a drilling method. As a mining method it describes using continuous-flow pressurized water or air being injected down through the annulus in association with the casing, using a rotatable inner dual-pipe system with a drilling shoe and a plurality of jet passages and jetting nozzles forcing mining debris up to the surface centrally through the inner pipe. Claringbull is a percussion-type of casing drilling system that advances the casing with an associated continuous-flow jet mining system using a rotary bit with water and air for mining. It uses differential water and air pressure to retrieve mining debris to the surface through a central pipe. The system is limited to mining at relatively shallow depths especially due to percussion energy dampening and has predictably low production capacity potential due primarily to the problem of retrieving dense drilling cuttings and debris with particle bridging and other issues inherent to moving slurry through conduits.

U.S. Pat. No. 4,536,035 to Huffman et al. describes multiple boreholes and the use of an inserted pumping tool and crusher to pump slurry up from a sump member, and it is particularly directed to mining an inclined seam of coal.

U.S. Pat. No. 3,747,696 to Wenneborg et al. uses a combination slurry drilling and mining system. It is a complex borehole apparatus with multiple inner conduits and moving valves, with mechanical hydraulic systems and modes for drilling and mining without requiring that the apparatus be pulled out of the borehole or well cavity. It uses a rotary-type drilling rig and does not use borehole casing. It is not a sonic-related system and is without pulsed jetting. It also requires significantly high positive pressure differentials to shift from drilling to mining mode.

Combined Sonic Drilling and Water Jet Mining Systems

U.S. Pat. No. 4,366,988 to Bodine discloses a sonic drill head type attached to a composite tool with a "sonic pump" that removes slurry from the mining site by vibratory action that creates intermittent pressure differentials facilitated by downhole foot valves located within the composite tool. Bodine does not describe entraining of fluid in the annulus or apparatus necessary to enhance hydraulic forces to move slurry up through the annulus to the surface of the borehole. Bodine describes a recovery method facilitated by vibration helping to move slurry and oil that rises to the surface as a "floating" extraction method but does not address the difficulty in maintaining high density slurry throughout the extraction process. Bodine uses vibratory action to move the liquid and mineral material in the side walls of a well bore and uses check valves within the piping assembly. Bodine describes jet action, but the swing jet rotors (source of resonant vibration) only affect the inner tubing member and do not generate a vibratory pulse to the jetting system from resonant vibration. Bodine describes an oscillating head that is detached from its jetting conduits which cannot generate a pulsed jetting or "pulsing" jets of water. Bodine uses a dedicated conduit with check valves to transport slurry to the surface. Bodine uses a complex "rod" comprised of external and internal rods welded concentrically together to form an annulus in stable "concentricity".

U.S. Pat. No. 3,797,590 to Archibald et al. describes a composite mining capsule that is inserted into a small borehole for subsurface submerged mining using a single non-pulsing jet and includes a downhole positive displacement pump and an inlet pipe for lifting dense slurry to the surface within a designated conduit from depths of 100 feet or deeper. Archibald teaches a pump member in a sump, which can be blocked by large boulders that can gravitate to the sump and may even trap the pump with boulders from a caving incident and can cause the loss of expensive downhole tools. Archibald uses a single continuous flow jet. Further, Archibald uses the sump member, sometimes referred to as a rat hole in the mining industry, to trap heavy and large mineral fragments. The Archibald mining tool and methods can result in boulder blockage at the sump as well as expensive loss of tooling and the system and methods do not use an eductor pump.

As a result of the lack of a viable commercial subsurface jetting system and methods, the mining industry often uses continuous-flow jetting in some mining situations where jetting can be applied, even though the continuous-flow jetting systems have relatively low mining production efficiency.

What is needed is an improved cost-effective, commercial-scale, efficient and adaptive subsurface borehole mining system and method that will allow for the immediate mining site analysis and mining of subsurface mineral resources, providing the mining industry and particularly sonic core drilling rig operators, the opportunity to mine a valuable discovered mineral deposit almost immediately to improve production rates and recovery of subsurface slurry, while minimizing environmental impact. The inventive system and method should provide a dynamic interaction between the sonic core drill rig operator, sonic drill head, a high-pressure high-volume hydraulic pump and a discovered and recoverable resource site that can be hundreds of feet deep but not available to traditional mining practices because of economic, safety or regulatory concerns. The system should be capable of propagating sonic wave energy to generate pulsed jets of water or other liquid at significant stand-off distances from a plurality of nozzles.

The system should be adaptable to existing sonic drilling systems to transform the existing sonic drilling systems into a highly efficient, low-frequency pulsing sonic and hydraulic mining system.

SUMMARY OF THE INVENTION

Sonically Pulsed System

An improvement to a sonic drilling system is provided. The existing sonic drilling system includes a rotating sonic head that is attached to at least one sonic rod. The sonic rod is connected to a drill bit for drilling or a coring bit for obtaining core samples, a water pump to pump water down the sonic rod to flush cuttings up the annulus between the sonic rod and a borehole formed by the drill bit and an optional length of borehole casing inside the borehole. The improvement to transform the sonic drilling system into a low-frequency pulsing sonic and hydraulic mining system comprises:

A high-pressure, high-volume water pump connected to a fluid supply and at least one length of casing having an inner surface in the borehole.

A sonic rod string that has a central bore comprises a plurality of sonic rods. The sonic rods are constructed of a substantially elastic material whereby walls of said sonic rods can move laterally to contact the inner surface of the casing and can expand and constrict to assist with the transfer of sonic vibration energy from the sonic drill head to the fluid from the water pump. An uppermost sonic rod is rotated and vibrated by the rotating sonic head.

An eductor coupling that has a central bore is threadably connected between an upper and a lower sonic rod. The eductor coupling includes at least one upwardly directed convergent nozzle having a diameter that becomes smaller from the inlet on an inner surface of the eductor coupling to an outlet on an outer surface of the eductor coupling. The outlet of the nozzle is positioned below an eductor. The eductor comprises a vacuum chamber formed by a depression in the outer surface of the eductor coupling, and a diffusing chamber formed by a depression in the outer surface of the eductor chamber. The vacuum chamber and the diffusing chamber are joined with a tapered indented section that is narrower than either the vacuum chamber or the diffusing chamber, whereby the eductor makes periodic contact with the inner surface of the casing to close the eductor against the inner surface of the casing whereby fluid and light slurry that flows upwardly in the annulus between the outer surface of the eductor coupling and an inner surface of the casing is drawn upwardly by the vacuum action of the eductor and whereby the nozzles direct pulsing hydraulic jet streams upwardly with upward annular flow to increase the upward vacuum action of the eductor and the eductor coupling.

A transition rod having a central bore, an upper end and a lower end is threadably connected below a lowermost sonic rod. The inner diameter at the upper end of the transition rod is substantially the same as the inner diameter of the lowermost sonic rod.

A sub-coupling having a central bore, an upper end, a lower end and at least one substantially laterally directed convergent jet nozzle is threadedly connected to a lower end of a lowermost transition rod. The sub-coupling has an inner diameter at its upper end that is substantially the same as the inner diameter at the lower end of the transition rod.

A shoe rock bit having a central bore is connected to a lowermost sub-coupling. The shoe rock bit has at least one downwardly directed convergent jetting nozzle for agitating heavy slurry into a sump trap and at least one crushing feature to crushingly fragment large rock fragments or boulders.

The water pump in the improvement to the sonic drilling system provides fluid down the central bore of the sonic rod string, the eductor, the transition rod, the sub-coupling and the rock bit whereby adjustable high-pressure, high-volume fluid is forced through the sonic rod string, the eductor, the transition rod, the sub-coupling and the rock bit to fracture, cut and agitate the targeted mineral into slurry and whereby the light slurry is directed effectively upwardly through the annulus to the surface for processing and extraction and for extracting and concentrating heavy slurry into the sump trap.

The transition rod includes a substantially frustum shaped interior in which the inner diameter at the upper end of the transition rod is larger than the inner diameter at the lower end of the transition rod. The general frustum shape is used to help direct and maintain fluid wave energy flow.

The eductor coupling includes a plurality of upwardly directed convergent nozzles wherein each of the nozzles are positioned below an eductor. The nozzles are angled upwardly from approximately 5 degrees to 20 degrees from a vertical axis. The eductor coupling also includes optional guidevanes integral to the central bore of the eductor coupling. The guidevanes are positioned to direct fluid flow axially and downwardly to reduce flow turbulence. The height of the guidevanes in the eductor coupling are between about one-hundredth and one-half of the internal diameter of the eductor coupling.

The water pump system is sized to provide continuous flow high-pressure and high volume fluid flow. The pressure is adjustable as desired from the range substantially between 200 psig and 2000 psig and the volume is adjustable as desired from the range of substantially between 20 gallons and 2000 gallons of water per minute.

At least one check valve is connected between the water pump and the sonic head to prevent oscillation fluid energy from transferring up from the rod string to the water pump and to isolate fluid flow to the at least one eductor coupling nozzle, the at least one sub-coupling nozzle, and to the annulus between the at least one casing member and the sonic rod string to improve significantly slurry lift and to minimize potential blockage of slurry flow.

The shoe rock bit and the sub-coupling extend below the at least one casing member whereby relatively low-frequency, adjustable oscillation energy is not directed into or through the casing string directly during the pulsed jetting mining process.

The transition rod optionally includes a plurality of guidevanes integral to the central bore of the transition rod. The guidevanes are positioned to direct fluid flow axially and downwardly and to reduce flow turbulence. The height of the guidevanes in the transition rod are between about one-hundredth and one-half of the internal diameter of the transition rod.

Each nozzle in the eductor, the sub-coupling and the rock bit are generally frustum in shape having a larger opening at the inside of the conduit and a smaller opening on the outside of the conduit.

At least two laterally directed convergent nozzle ports are provided through a wall of the sub-coupling, each of the nozzle ports are positioned substantially laterally apart from one another and are directed approximately 90 degrees from the direction of water flow through the sub-coupling.

The sub-coupling optionally includes a plurality of guidevanes integral to the central bore of the sub-coupling. The guidevanes are positioned to direct fluid flow axially and downwardly and to reduce flow turbulence. The sub-coupling guidevanes are substantially triangular in cross section and have a base. The height of the sub-coupling guidevanes are ½ to 1/100 the diameter of the central bore of the sub-coupling, the width of the sub-coupling guidevanes are between about ⅔ and 1/20 the height of the guidevanes.

The rock bit optionally includes a plurality of guidevanes integral to the central bore of the rock bit. The rock bit guidevanes are positioned to direct fluid flow axially and downwardly and to reduce flow turbulence. The rock bit guidevanes are substantially triangular in cross section and have a base. The height of the rock bit guidevanes are ½ to 1/100 the diameter of the central bore of the rock bit and the width of the rock bit guidevanes are between about ⅔ and 1/20 the height of the guidevanes.

A tower is provided to raise, lower and rotate the rotating sonic head. An adapter is attached between the tower and the rod string. The adapter receives fluid from a high pressure fluid conduct supplied from the water pump and receives energy waves from the sonic drill head whereby fluid and energy waves are transferred through the adapter to the sonic rod string.

Enhanced Borehole Mining Method

Also disclosed is an enhanced method for borehole mining, separating and extracting heavy and light minerals, gems and metals from a target deposit comprising the steps of:

a. drilling a borehole using a low-frequency pulsing sonic and hydraulic mining system including a downhole pulsed jetting assembly;
b. inserting at least one length of borehole casing having an inner surface into the borehole above depth of the target deposit;
c. inserting and rotating the downhole pulsed jetting assembly into the borehole casing with a sub-coupling and a pulsed jetting shoe rock bit both positioned below the borehole casing;
d. pumping fluid into the borehole;
e. monitoring light slurry at surface of the borehole and evaluating content of light slurry and density of the light slurry;
f fracturing, agitating and disaggregating materials at the target deposit with pulsed jets from pulsed jetting nozzles in the sub-coupling and with pulsed jets from pulsed jetting nozzles in the pulsed jetting shoe rock bit causing light slurry to flow upwardly to an annulus formed between the inner surface of the borehole casing and outside of the downhole pulsed jet assembly, then upwardly through the annulus to the surface of the borehole thereby causing heavy slurry to concentrate in a sump, the sump being located below the pulsed jetting shoe rock bit;
g. continuing to fracture, agitate and disaggregate materials according to step f to form a cavity at the target deposit;
h. removing the downhole pulsed jetting assembly from the borehole and running a core barrel to extract heavy slurry that is concentrated in the sump;
i. analyzing the heavy slurry and the light slurry to determine whether to repeat steps a through h.

The inventive method for mining minerals, gems and metals from a target deposit wherein step e also includes using a sub-coupling having pulsed jetting nozzles together with the pulsed jetting shoe rock bit.

The inventive mining method can also include at least one eductor coupling is positioned in the downhole pulsed jetting assembly to enhance upward flow of light slurry to surface of borehole.

A method for mining minerals, gems and metals from a target deposit wherein after step g, continuing to fracture, agitate and disaggregate materials according to step f to form a generally spherical shaped cavity at the target deposit.

The inventive method can also include the additional step of moving light slurry from a catch box at the surface of the borehole to a processing system to separate water, minerals, gems and metals obtained from the target deposit.

A method for mining minerals, gems and metals from a target deposit including the following additional steps after step i:

j. inserting at least one additional length of borehole casing into the borehole below ceiling of the cavity, including adding a plurality of eductor couplings into the downhole pulsed jetting assembly;
k. inserting the downhole pulsed jetting assembly into the borehole and through the borehole casing; and
l. repeating steps a through i until it is determined that the target deposit does not contain sufficient target mineral to justify continuing the operation.

When at least one eductor coupling is included in the mining method, including the additional step of contacting an outer surface of at least one eductor on the at least one eductor coupling to the inner surface of the borehole casing to at least partially close the outer surface of the at least one eductor to enhance the upward vacuum of light slurry in the annulus between the inner surface of the borehole casing and the outside of the downhole pulsed jet assembly from the target deposit to the surface.

The method can include the additional step of maintaining and monitoring a substantially high hydrostatic level of the borehole and cavity to enhance eductor coupling function and light slurry hydraulic extraction and to resist cavity ceiling subsidence of the cavity.

Features, Advantages and Benefits of Inventive System and Method

The inventive system and method are capable of subsurface mining excavation and simultaneous eductor recovery facilitation without submersible valves or complicated tooling that can be attached to a sonic core-drilling machine (i.e. sonic drill head) for subsurface pulsed jetting mining in a commercially efficient manner.

The inventive system and method are capable of interchangeably using the rods and casing of an existing sonic drilling system to transform an existing sonic core drilling rig into a sonic mining rig.

The inventive system and method provides an improved economic alternative for efficient subsurface mining using sonically pulsed high-pressure, high-volume jetting with simultaneous excavation and slurry recovery The inventive system and method requires minimal lead-time from discovery of a valuable mineral deposit to recovery with its sonically pulsed jetting excavation system in a very eco-friendly manner.

Multiple boreholes can be used with the inventive system and method to generate higher slurry recovery rates with a deep deposit, especially since more efficient sonically pulsed jetting mining is used to generate slurry. In the situation of a significantly inclined seam, a modified sub-coupling using three pulsed jetting nozzles may be used, depending on the logistics of maintaining rod stability at the mining site. At an incline and with denser slurry (e.g. mining coal) the depth that the inventive system and method can work should be much greater than in a vertical orientation and may not even require an additional independent eductor in a sump orientation, especially extending the casing string length by adding sections of additional sonic casing thereby positioning the sonic casing string and slurry collecting annulus lower opening into the mining cavity and closer behind the advancing pulsed jetting sub-coupling with additional eductor sub-couplings being added to the rod string, Being able to add casing sections to facilitate denser slurry engagement can increase recovery as needed and can allow recovery of certain deposits that would otherwise be left in the ground.

The inventive system and method economically enhances the subsurface borehole exploratory and mining process in multiple ways. First it achieves this by using pulsed jetting to generate more efficient jetting excavation and eductor coupling movement of slurry, simultaneously being performed with the single tubular and attachable multi-sectional mining apparatus system and method. Second, the inventive system and method benefit from drilling the borehole quickly using an established sonic drill rig, emplacing a sonic borehole casing string, removing the sonic core barrel tool member from the rod string to determine the value of a discovered mineral site and to attach the inventive mining tools that are reinserted into the borehole for efficient pulsed jetting to erode and cut mineral deposits. Simultaneously, pulsed jetting in one or more eductor coupling apparatus help facilitate slurry movement up to the surface through the annulus for processing and recycling water for reuse. By sonically propagating and using sonic wave energy in addition to pump energy, various hydraulic pulsed jets are generated through appropriate nozzle design and application, for either a cutting/agitating function or an eductor function. The inventive system does not require moveable downhole hardware which can reduce operational expenses and downtime.

Having a sonic head attachment interfaced with a high-pressure high volume water column is critical for pulsing the jet, which is central to the purpose of presenting a more economical means of mining mineral material.

A jetting system without a pulsing influence can only present a continuous-flow, high-pressure jetting operation, which is less efficient and not as economical as the pulsed jetting mining of the inventive system and method. Even without the pulsing component to the jets, the inventive system used with a sonic drill rig is unique in its simpler design and uninterrupted eductor facilitation of recovery of slurry through the annulus. Also, the inventive system and method provides additional benefits from the recovery potential provided by the sonic rig supported sump and core barrel recovery method.

The inventive system and method provides a subsurface modulated pulsed jetting mining operation that is efficient in production and mobile, generally speaking but not in a limiting sense, using a sonic drill head mounted on a sonic drill rig platform for providing pulsing energy through the spindle to the sonic rods, use of the proposed inventive sonic jet tooling and sonic rod string in conjunction with a high-pressure (e.g. 500-1500 psig), high-flow (e.g. 300-600 gal/min) water pump, water source and supportive equipment, working within and beneath an unattached sonic borehole casing and using appropriate efficient short nozzle designs, such as a quartic-type nozzle design for rock breakage at a substantial long stand-off distance, in conjunction with hydraulic pump continuous-flow pressure jet mining consistent with prior associated research in jet mining. The long stand-off distance is an important advantage of the instant inventive system because of its improved efficiency and effectiveness in comparison to pulsed jet mining using nozzles with a short stand-off distance.

The inventive system and method does not have the potentially disastrous problem caused by use of a downhole pump because the inventive system and method use a sump to trap large heavy slurry solids for later recovery using a sonic core barrel.

The inventive system and method also produces and uses positive hydraulic pressure inherent to recycling significant water volume (e.g. approximately 400 to 500 gallons of water per minute) through the mining site, initially entering the site by exiting from the mining tools into the mining site and then upwardly into the annulus space and onto the surface.

The inventive system and method sub-coupling with nozzles is a pulsed jetting member using usually a plurality of pulsed jetting streams to fracture and erode target mineral as well as to agitate dense slurry moving it into the ceiling entrance of the annulus space between the rod and casing strings, with high-density of slurry being maintained as it is transported upwardly to the surface in part by means of eductor couplings with pulsing jets. Slurry recovery through the annulus is facilitated by a multiplicity of eductor couplings using small pulsed jetting streams entraining the slurry and helping to lift slurry and facilitate the inherent hydraulic forces moving fluid up through the annulus.

The inventive system and method uses a shoe rock bit with at least one pulsed jetting nozzle to fracture boulders that gravitate to the sump member and also to agitate lighter mineral fragments into the slurry and into the annulus in the ceiling of the mined cavity. The sump is used to trap heavy material that will periodically be retrieved using a core drill, which can be quickly used to also analyze the mineral site and deepen the cavity. Once the cavity becomes too deep for dense slurry to enter the annulus space in the cavity ceiling an independent eductor which is commonly used in the prior art can be inserted through a second borehole into the cavity as an independent eductor mechanism as a facilitating method to improve the rate of recovering large deposits using the efficient pulsed jetting excavation method or the site can be abandoned if deemed uneconomic. The inventive system and method, depending on its scale of operation, can pulse its jets with a mean pressure within a range between approximately 200 psig and 2000 psig, with a mean flow rate between approximately 20 gallons and 2000 gallons per minute, within a sonic low-frequency range of about 1 Hz to 300 Hz, all of which can be varied in different ways depending on multiple factors, such as mineral type, nozzle type and oscillating rate.

The inventive system and method is very economical because lighter jetted debris material tends to agitate quickly upward through the annulus, separating from the heavier elements which gravitate to the sump along with boulders which can be easily fractured by applying pressure from the terminal shoe rock bit having the additional benefit of downwardly pulsing jet with fragments further agitated and flushed up to be fragmented further with the lateral pulsing jets, which are positioned immediately above the terminal shoe rock bit. The terminal shoe rock bit with its central pulsing jet can also constantly agitate the contents of the sump trap, which is located immediately below the shoe rock bit, as well as perform fracturing of any boulders that gravitate to and block the sump. Using an impingement pulsed jetting force as well as shearing rotational and compressive forces applied by mechanical contact of the shoe rock bit to a boulder; boulders at the sump do not present a problem of capturing and sticking the inventive system and method.

Periodically the rod string and other downhole components of the inventive system are removed from the mining site. The sonic core barrel can then be reattached to the sonic rod string and can be reinserted into the borehole recovering the sump contents, in an innovative method to recover extra heavy jetting debris, which are extruded at the surface, with core barrel detachment at which time the downhole components of the inventive system are reattached to the sonic rod string for continuing the pulsed jetting mining, but with a newly opened sump. This exchange can be done very quickly. This mining process can be accomplished through a small borehole, for example 9.25 inch diameter borehole to easily excavate a 300 to 400 foot deep resource site and much deeper.

The inventive system includes a sub-coupling with multiple lateral pulsing jets having nozzle exit dimensions that are flush with the sonic rod string external wall dimensions which allows for unimpeded sonic retrieval of the inventive sonic apparatus and sonic rod string from the subsurface mining site should a caving incident occur and still allows recovery of the sump contents using a sonic core barrel. The inventive system allows for surface processing of slurry and recycling of water or storage. The inventive system and method allow for refilling the site with gangue and recovery of sonic casing, as is considered standard practice in the art of borehole mining.

The inventive system has no moving parts which reduces the possibility and frequency of equipment break downs, which can be a significant problem when operating mining equipment in remote locations.

The inventive system can be retrieved and provides multiple methods for slurry extraction whereby the inventive system is capable of using multiple eductors and eductor couplings along other options to modify the mining rate for optimal recovery.

The inventive pulsed jetting mining system can be economically more efficient by consuming less amounts of water and energy as compared to a continuous-flow jetting system. Pulsed jets can be more efficient at eroding and breaking target mineral materials by applying intermittent stress pulses as compared to continuous-flow jets; electrically, mechanically and acoustically propagated pulsed waves can be generated and modulated in a high-pressure hydraulic system; effective pulse energy can be propagated at significant stand-off distances from a jetting nozzle; and nozzle design can significantly produce different jet stream and pulsed characteristics.

DETAILED DESCRIPTION

Figure 1:
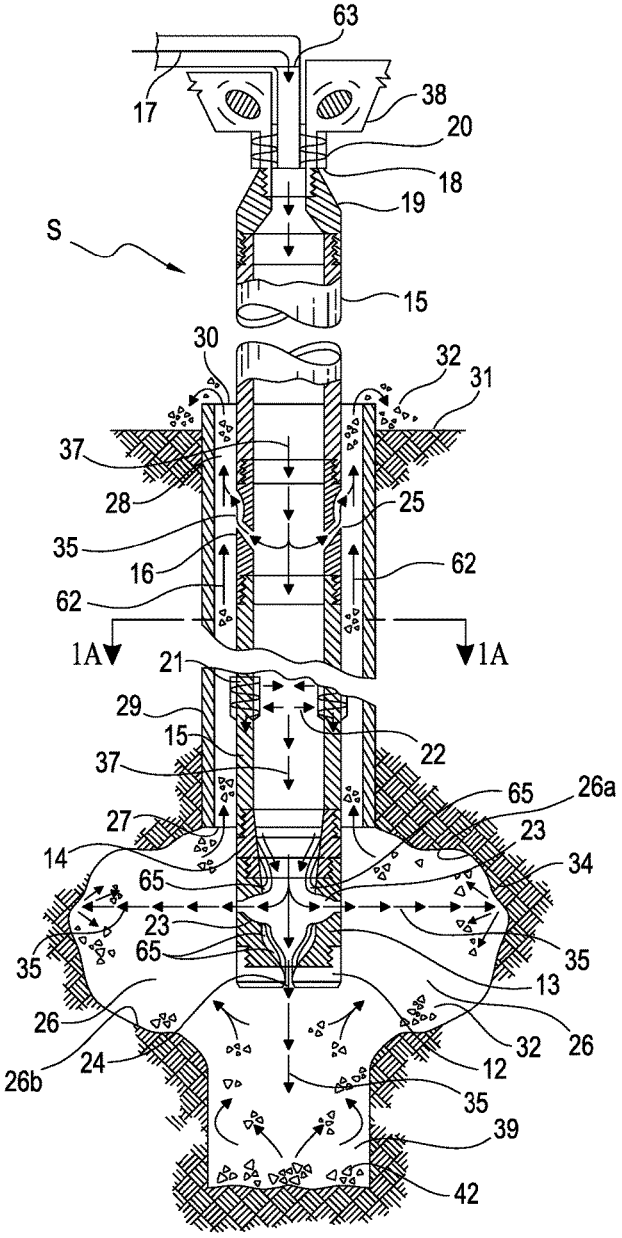
FIG. 1 is a partial sectional front view of the inventive sonically pulsed apparatus for sonically jet mining a subsurface mineral site, including fluid flow for jetting excavation and simultaneous jetting eductor coupling extraction functions.
Figure 1A:
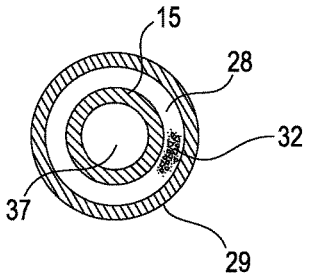
FIG. 1A is a sectional view taken on line 1A-1A of FIG. 1.

The following table lists the part numbers and part descriptions as used herein and in the figures attached hereto:

| Part Number: | Description: |
|---|---|
| S | Inventive sonic pulsed jetting system |
| 12 | Pulsed jetting shoe rock bit |
| 12a | Upper end of rock bit |
| 13 | Pulsed jetting sub-coupling |
| 13a | Threaded upper end of sub-coupling |
| 13b | Threaded lower end of sub-coupling |
| 14 | Transition rod |
| 14a | Threaded upper end of transition rod |
| 14b | Threaded lower end of transition rod |
| 14c | Upper inner diameter of transition rod |
| 14d | Lower inner diameter of transition rod |
| 15 | Sonic rod |
| 15a | Sonic rod string (multiple sonic rods) |
| 16 | Pulsed jetting eductor coupling |
| 16a | Threaded upper end of eductor coupling |
| 16b | Threaded lower end of eductor coupling |
| 17 | Fluid column and flow direction of high-pressure and high-volume fluid |
| 18 | Sonic drill head spindle |
| 19 | Adapter attaching sonic rod string to the sonic drill head spindle |
| 20 | Sinusoidal waves propagated by oscillating parts of the sonic drill head |

-continued

| Part Number: | Description: |
|---|---|
| 21 | Sonic wave expansion and contraction of a sonic rod |
| 22 | Pulsing energy transferred by interfacing to high-pressure liquid column |
| 23 | Sub-coupling pulsed jetting nozzle |
| 23a | Sub-coupling pulsed jetting nozzle inlet |
| 23b | Sub-coupling pulsed jetting nozzle outlet |
| 24 | Shoe rock bit pulsed jetting nozzle |
| 25 | Eductor coupling pulsed jetting nozzle |
| 25a | Eductor coupling pulsed jetting nozzle inlet |
| 25b | Eductor coupling pulsed jetting nozzle outlet |
| 26 | Subterranean pulsed jetting mining excavated cavity |
| 26a | Cavity ceiling |
| 26b | Cavity floor |
| 27 | Casing string's bottom end |
| 28 | Annulus space between the sonic rod string and casing |
| 29 | Casing |
| 29a | Inner surface of casing |
| 30 | Casing collar |
| 31 | Ground level |
| 32 | Slurry |
| E | Eductor formed from eductor coupling vacuum chamber, vacuum chamber taper and eductor coupling diffusing chamber |
| 33 | Eductor coupling vacuum chamber |
| 33a | Vacuum chamber taper |
| 34 | Mineral target being cut by pulsed fluidic jetting streams |
| 35 | Pulsed jetting stream |
| 36 | Eductor coupling diffusing chamber |
| 37 | High-pressure fluid flowing through a sonic rod |
| 38 | Oscillating sonic drill head |
| 39 | Sump for collecting large, heavy slurry for core barrel retrieval to surface |
| 40 | Slurry catch box |
| 41 | Pump actuator |
| 41a | Water level sensor connected to casing collar |
| 42 | Sump slurry concentrate |
| 43 | Tower of the sonic drill rig supporting the sonic head |
| 44 | High-pressure fluid conduit |
| 45 | High-pressure/high-volume flow fluid pump |
| 46 | One-way check valve |
| 47 | Pressure release valve |
| 48 | High-volume main slurry pump |
| 49 | Slurry conduit flowing to accessory slurry pump and slurry box |
| 50 | Slurry box on processing platform |
| 51 | Hydrostatic maintenance conduit connecting annulus to reserve reservoir |
| 52 | Hydrostatic maintenance high-volume low pressure pump |
| 53 | Hydrocyclone/screen water clarification member |
| 54 | Clarified water conduit with high-volume, low-pressure pump |
| 55 | Main water reservoir |
| 56 | Cistern on processing platform |
| 57 | Processing platform with sluice, jigs, screens, gravity concentrator |
| 58 | Sonic drill rig |
| 59 | Collapsible water reservoir |
| 60 | Discharge gravel gangue |
| 61 | Uncased borehole |
| 62 | Slurry lift |
| 63 | Water swivel |
| 64 | Rotation |
| 65 | Guidevane to assist flow performance in line with pulsed jetting nozzle |
| 65a | Guidevane to assist flow performance offset 90° from pulsed jetting nozzle |
| 66 | Shoe rock bit crusher plate |
| 67 | Sonic core barrel |

Inventive Apparatus

Figure 1B:
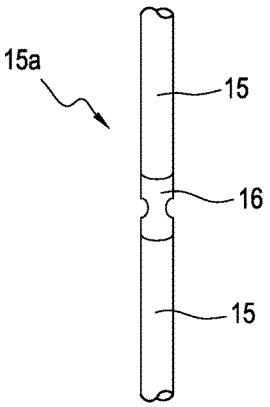
FIG. 1B is a side view of a sonic rod string that includes multiple sonic rods and one or more eductor couplings

Refer now to FIG. 1 in which a partial cross-sectional view of the inventive pulsed jetting system S is shown in a mining site. An oscillating sonic drill head 38 is shown at the top of the inventive pulsed jetting system S. An adapter 19 is threadedly connected to the lower end of the sonic drill head 38. A sonic rod 15 is threadedly connected to the lower end of the adapter 19. When multiple sonic rods 15 are connected together, a sonic rod string 15*a* is formed as shown in FIG. 1B. In a sonic rod string 15*a*, one or more eductor couplings 16 can be included and normally an eductor coupling 16 is connected between each two sonic rods 15. A pulsed jetting eductor coupling 16 is attached below the sonic rod 15 or sonic rod string 15*a* if multiple sonic rods 15 are used. A sonic rod 15 or rod string 15*a* is threadedly connected to the lower end of the eductor coupling 16. A transition rod 14 is threadedly connected to the lowermost sonic rod 15. A pulsed jetting sub-coupling 13 is threadedly connected to the lower end of the transition rod 14. A pulsed jetting shoe rock bit 12 is threadedly connected to the lower end of the sub-coupling 13.

Figure 2:
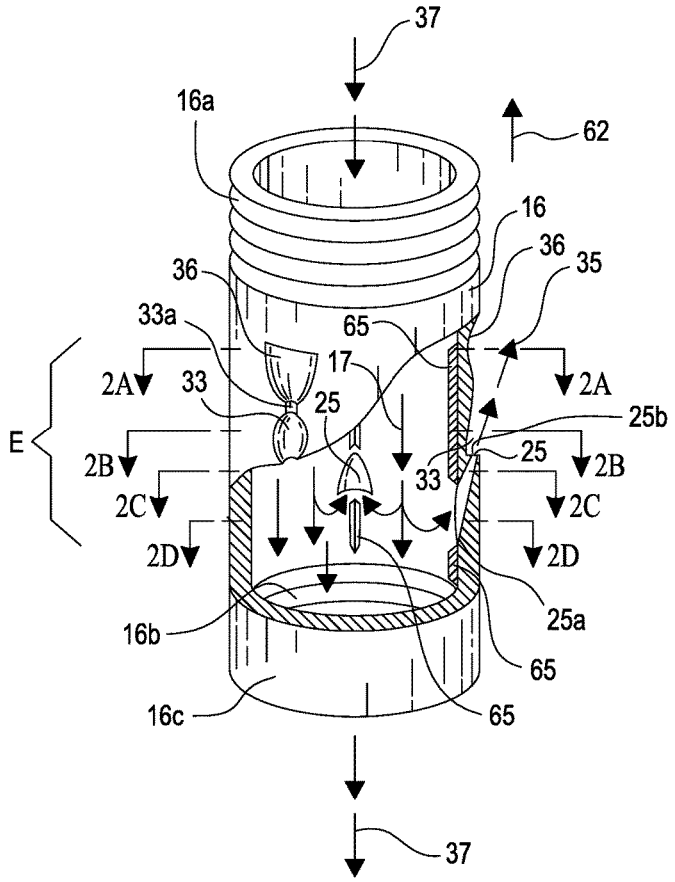
FIG. 2 is a perspective view of a typical inventive pulsed jetting eductor coupling member, with a partial section showing jetting nozzles with vacuum and diffusing chambers profiled. Also shown are optional guidevanes.
Figure 2A:
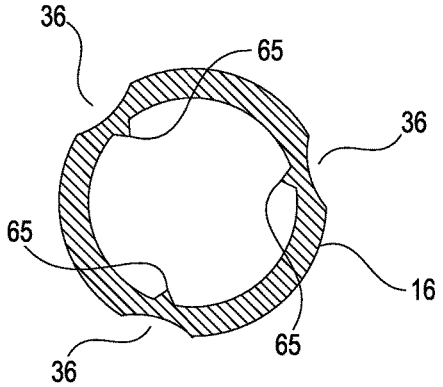
FIG. 2A is a sectional view taken along line 2A-2A of FIG. 2.
Figure 2B:
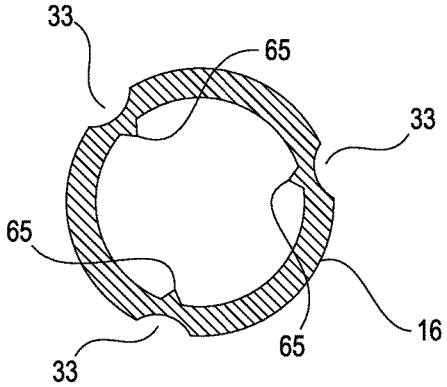
FIG. 2B is a sectional view taken along line 2B-2B of FIG. 2.

Each component of the inventive pulsed jetting system S will now be described in detail before the overall functionality of the system is explained. A perspective view of an inventive pulsed jetting eductor coupling 16 is shown in FIG. 2. The eductor coupling 16 is typically 8-20 inches long and is constructed of a metallic or nonmetallic material. The eductor coupling 16 includes a threaded upper end 16*a* and a threaded lower end 16*b*. An eductor E is formed on the outer surface of the eductor coupling 16. Each eductor E comprises a vacuum chamber 33 and a diffusing chamber 36. The vacuum chamber 33 and diffusing chamber 36 are joined with a vacuum chamber taper 33*a*. The vacuum chamber taper 33*a* is narrower than either the vacuum chamber 33 or the diffusing chamber 36. One or more eductor coupling 16 pulsed jetting nozzles 25 include an inlet 25*a* and an outlet 25*b*. The outlet 25*b* of the pulsed jetting nozzles 25 is typically positioned below the vacuum chamber 33 of the eductor E. The pulsed jetting nozzles 25 are convergent in shape such that the outlet 25*b* diameter is smaller than the inlet 25*a* diameter. Typically, three eductors E with corresponding three pulsed jetting nozzles 25 are included on the eductor coupling 16. The pulsed jetting nozzles 25 are angled upwardly from about 5° to 20° from vertical. Both the inlet 25*a* and outlet 25*b* are between 0.01-0.35 inches in diameter, but the inlet 25*a* is larger than the outlet 25*b*. Optional guidevanes 65 are internal to the eductor coupling 16 and assist with the laminar flow guidance of the high-pressure fluid 37 flowing through the eductor coupling 16. The guidevane 65 height is approximately one-hundredth to one-half of the internal diameter of the eductor coupling 16 and the guidevanes 65 are generally triangular in cross section. Guidevanes 65 are shown in FIG. 2A on the section view that is taken along line 2A-2A of FIG. 2. The diffusing chamber 36 is shown in line with the guidevanes 65. Guidevanes 65 are also shown in FIG. 2B on the section view that is taken along 2B-2B of FIG. 2. The vacuum chamber 33 is shown in line with the guidevanes 65.

Figure 2C:
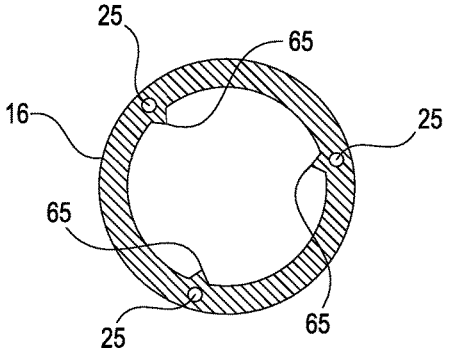
FIG. 2C is a sectional view taken along line 2C-2C of FIG. 2.

FIG. 2C is a sectional view taken along line 2C-2C from FIG. 2. In FIG. 2C the guidevanes 65 are shown in line with the pulsed jetting nozzles 25.

Figure 2D:
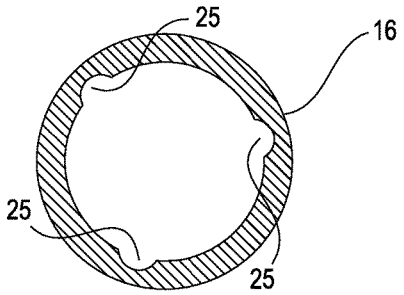
FIG. 2D is a sectional view taken along line 2D-2D of FIG. 2.

FIG. 2D is a sectional view taken along line 2D-2D from FIG. 2. In FIG. 2D a portion of the pulsed jets 25 on the interior of the eductor coupling 16 are shown.

Figure 3:
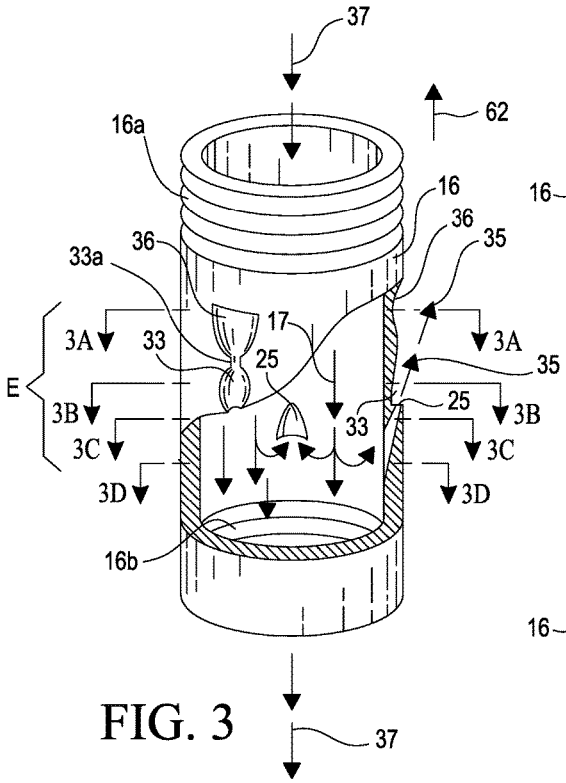
FIG. 3 is a perspective view of a typical inventive pulsed jetting eductor coupling member, with a partial section showing jetting nozzles with vacuum and diffusing chambers profiled.

In FIG. 3 an eductor coupling 16 is shown in which no guidevanes 65 are present. Guidevanes 65 are an optional feature.

Figure 3A:
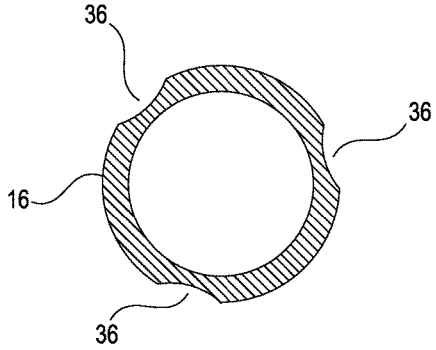
FIG. 3A is a sectional view taken along line 3A-3A of FIG. 3.

FIG. 3A is a sectional view taken along line 3A-3A from FIG. 3. FIG. 3A is identical to FIG. 2A except that guidevanes 65 are not present.

Figure 3B:
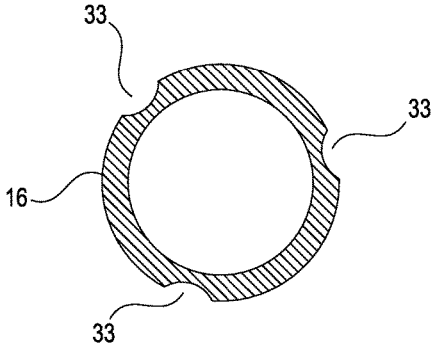
FIG. 3B is a sectional view taken along line 3B-3B of FIG. 3.

FIG. 3B is a sectional view taken along line 3B-3B from FIG. 3. FIG. 3B is identical to FIG. 2B except that guidevanes 65 are not present.

Figure 3C:
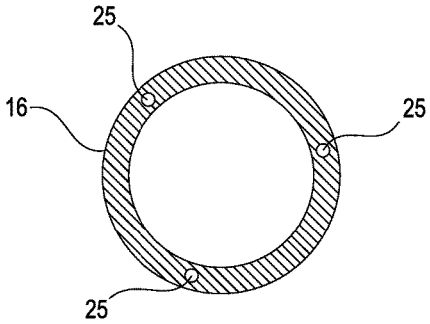
FIG. 3C is a sectional view taken along line 3C-3C of FIG. 3.

FIG. 3C is a sectional view taken along line 3C-3C from FIG. 3. FIG. 3C is identical to FIG. 2C except that guidevanes 65 are not present.

Figure 3D:
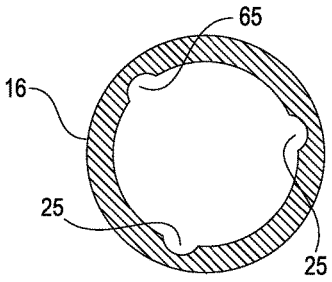
FIG. 3D is a sectional view taken along line 3D-3D of FIG. 3.

FIG. 3D is a sectional view taken along line 3D-3D from FIG. 3. FIG. 3D is identical to FIG. 2D.

Figure 4:
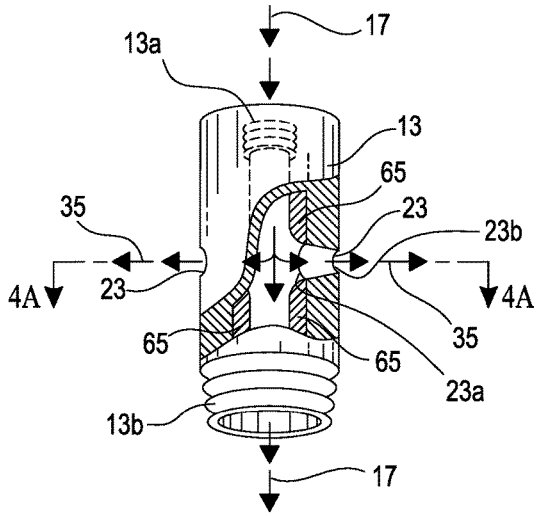
FIG. 4 is a perspective view of a typical inventive pulsed jetting sub-coupling member, with a partial section showing diametrically opposed nozzles and guidevanes for sonically pulsing coherent hydraulic streams for optimizing target mineral excavation.
Figure 4A:
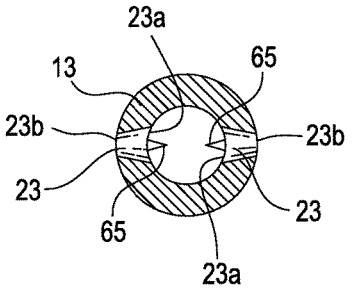
FIG. 4A is a sectional view taken along line 4A-4A of FIG. 4 showing guidevanes in line with pulsed jetting nozzles.

A perspective view is shown in FIG. 4 of a typical inventive pulsed jetting sub-coupling 13, with a partial section showing diametrically opposed nozzles 23 and optional guidevanes 65 for sonically pulsing coherent hydraulic streams for optimizing target mineral excavation. The sub-coupling 13 is typically 4-12 inches long and is constructed of a metallic or nonmetallic material. The nozzles 23 are typically 0.3-1.0 inches in diameter and the diameter of the inlet 23*a* is as much as 40 times the diameter of the exit 23*b*. The guidevanes 65 height is ½ to 1/100 the inner diameter dimension of the sub-coupling 13. Internal threads are provided to attach the upper end 13*a* of the sub-coupling 13 to the lower end 14*b* of the transition rod 14 and external threads are provided to attach the lower end 13*b* of the sub-coupling 13 to the upper end 12*a* of the rock bit 12.

Figure 5:
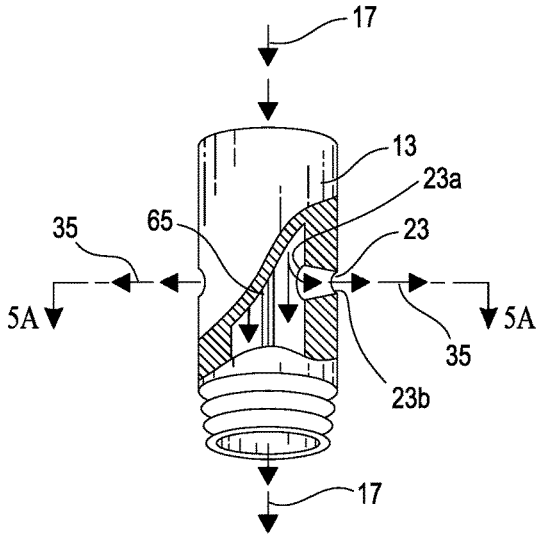
FIG. 5 is a perspective view of a typical inventive pulsed jetting sub-coupling member, with a partial section showing diametrically opposed nozzles and guidevanes for sonically pulsing coherent hydraulic streams for optimizing range for mineral target excavation.

FIG. 5 shows a sub-coupling 13 in which optional guidevanes 65 are each positioned 90 degrees away from pulsed jetting nozzles 23.

Figure 5A:
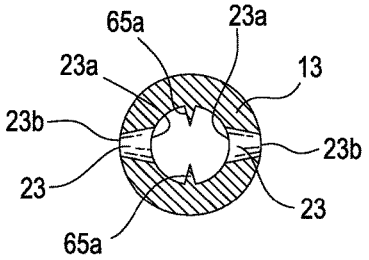
FIG. 5A is a sectional view taken along line 5A-5A of FIG. 5 showing guidevanes offset 90 degrees from pulsed jetting nozzles.

FIG. 5A shows a sectional view of sub-coupling 13 taken along line 5A-5A from FIG. 5. The guidevanes 65*a* in FIG. 5A are each positioned 90 degrees away from jets 23.

Figure 6:
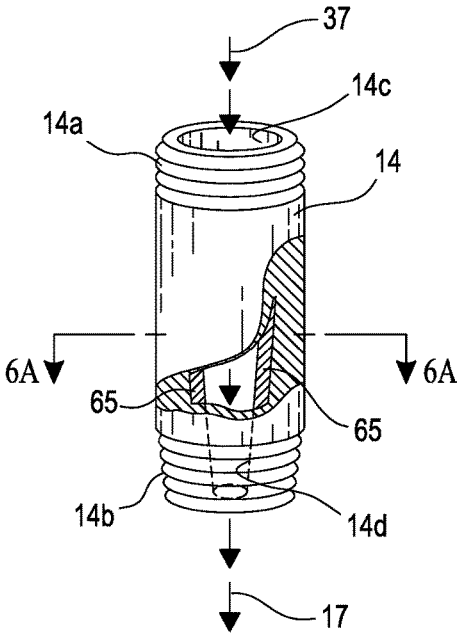
FIG. 6 is a perspective view of a typical inventive pulsed transition rod member that attaches the sonic rod string above to the pulsed jetting sub-coupling below, with a partial section showing guidevanes that may be incorporated to help reduce turbulence and optimize pulsed coherent water jet production by the attached sub-coupling short nozzle members.
Figure 6A:
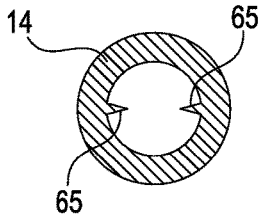
FIG. 6A is a sectional view taken along line 6A-6A of FIG. 6.

A perspective view is shown in FIG. 6 of a typical inventive pulsed transition rod 14. The transition rod 14 includes a threaded upper end 14*a* that attaches to the lower end of the rod string 15*a* and a threaded lower end 14*b* that attaches to the upper end 13*a* of the sub-coupling 13. The inner bore of the transition rod 14 tapers with a frustum shape such that the upper inner diameter 14*c* of the transition rod 14 at the upper end 14*a* is substantially the same as the inner diameter of the sub-coupling 13 and the inner diameter 14*d* of the transition rod 14 at the lower end 14*b* is substantially the same inner diameter of the sub-coupling 13. Optional guidevanes 65 are shown internal to the transition rod 14 and the triangular cross-sectional profile of the guidevanes 65 can be seen in FIG. 6A.

Figure 7:
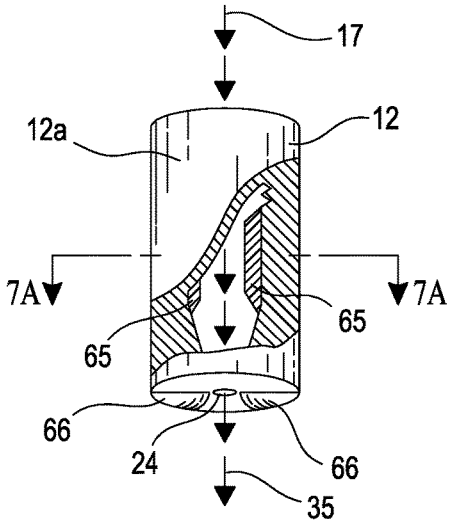
FIG. 7 is a perspective view with a partial section of a typical pulsed jetting rock shoe bit member with a centrally located jetting nozzle and two crushing plates that facilitate boulder breaking and general slurry agitation and sump concentration of heavy mining slurry.
Figure 7A:
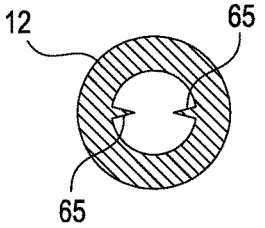
FIG. 7A is a sectional view taken along line 7A-7A of FIG. 7.

A perspective view is shown in FIG. 7 of a typical inventive pulsed jetting rock shoe bit 12 with a centrally located jetting nozzle 24 and two crushing plates 66 that facilitate boulder breaking and general slurry agitation and sump concentration of heavy mining slurry. Also shown in FIG. 7 are optional guidevanes 65 which direct flow 17 downwardly. The triangular cross-sectional profile of the guidevane 65 can be seen in FIG. 7A.

Referring again to FIG. 1, the downhole components of the inventive sonic pulsed jetting system S comprise the pulsed jetting shoe rock bit 12, the pulsed jetting sub-coupling 13, the transition rod 14, at least one sonic rod 15 (multiple sonic rods comprise a rod string 15*a*) and a pulsed jetting eductor coupling 16. The fluid column and flow direction of high-pressure and high-volume fluid is shown at 17. The high-pressure and high-volume fluid 17 flows through the water swivel 63 and down the bore of the downhole components of the inventive system S at 37. The oscillating sonic drill head 38 produce sinusoidal waves 20 which propagate down and through each of the downhole components of the inventive sonic pulsed jetting system S. As the high-pressure fluid 37 passes down the bore of the downhole components of the inventive sonic pulsed jetting system S, the high-pressure fluid 37 is forced out of the eductor coupling pulsed jetting nozzles 25, the sub-coupling convergent pulsed jetting nozzles 23, and the shoe rock bit's convergent pulsed jetting nozzle 24. A pulsed jetting stream 35 is generated below the shoe rock bit's 12 convergent pulsed jetting nozzle 24. Slurry 32 is forced upwardly in the annulus 28 between the downhole components of the inventive system S and the casing 29.

Figure 2E:
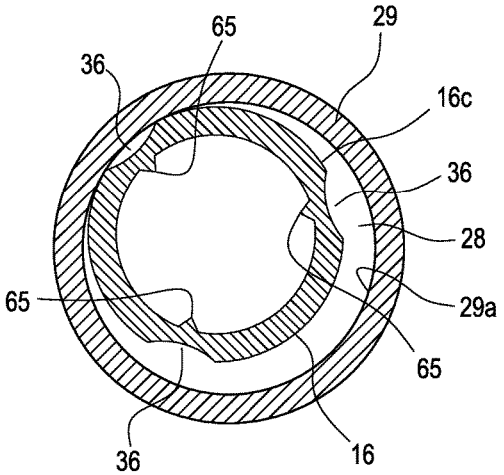
FIG. 2E is a sectional view of the pulsed jetting eductor coupling taken along line 2A-2A of FIG. 2 and a sectional view of borehole casing. The diffusing chamber of an eductor on the eductor coupling is shown in contact with the inner wall of the borehole casing.

In an important aspect of the invention, as shown section in FIG. 2E, the outer surface 16*c* of an eductor E of an eductor coupling 16 including the vacuum chamber 33 (not shown) the diffusing chamber 36 and the vacuum chamber taper 33*a* (not shown) make contact with the inner surface 29*a* of the casing 29. The contact occurs because downhole components of the sonic pulsed jetting system S is flexible along its length such that the individual components of the downhole components of the sonic pulsed jetting system S, including each eductor E, are free to move laterally within the casing 29. Typically, the outer surface 16*c* of only a single eductor E will contact the inner surface 29*a* of the casing 29 at any given point in time. When the outer surface 16*c* of an eductor E makes contact with the inner surface 29*a* of the casing 29 upwardly flowing slurry lift 62 (best seen in FIGS. 1 and 2) passes from the vacuum chamber 33 through the vacuum chamber taper 33*a*, then through the diffusing chamber 36. The eductor E produces a Venturi effect which causes the flow of the upwardly flowing slurry lift 62 to accelerate as it passes into and through the diffusing chamber 36.

Eductor couplings 16 can be added intermittently between sonic rods 15 in the sonic rod string 15*a* as desired to facilitate slurry lift to the surface through the annulus 28 from the mining cavity 26 using the Venturi effect.

Figure 14:
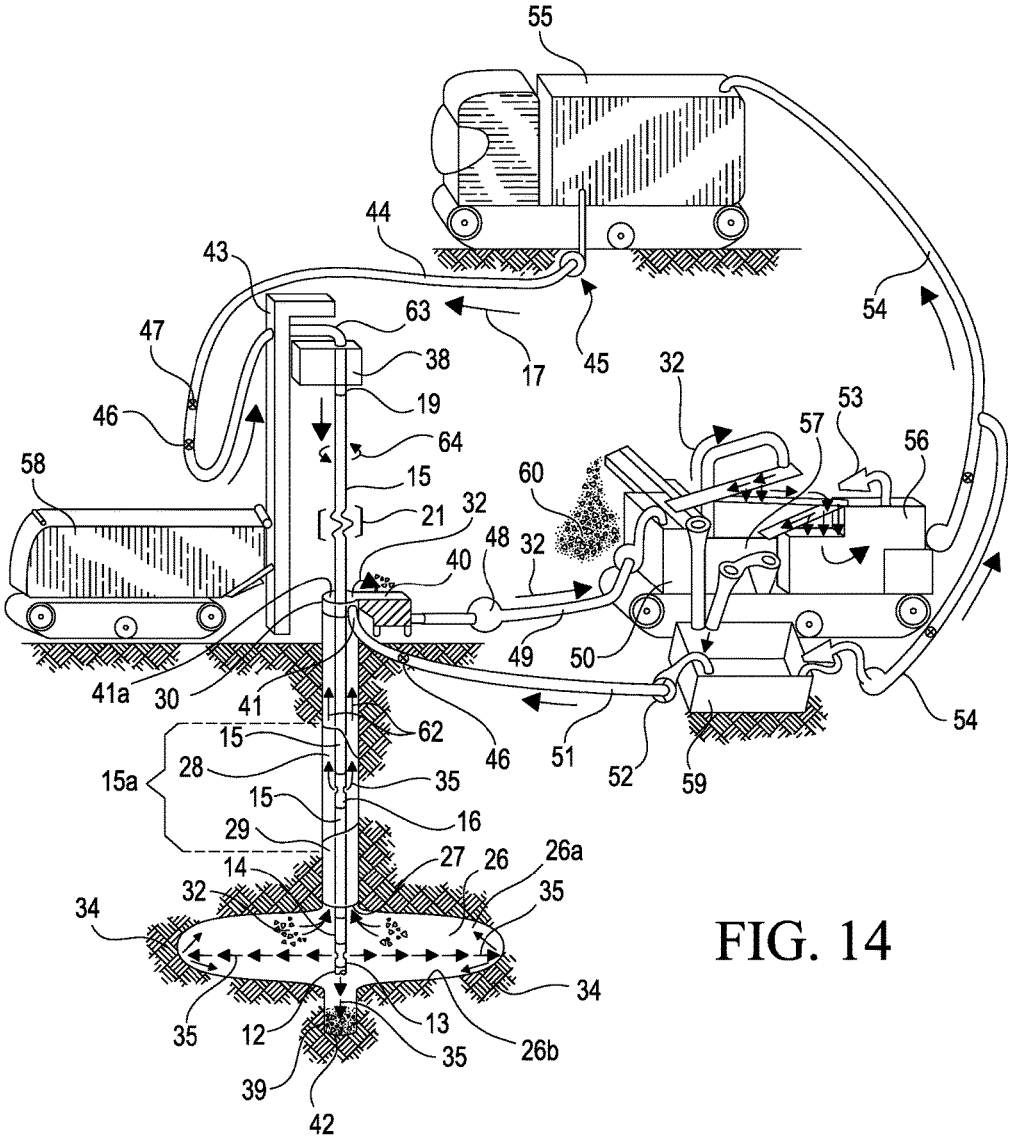
FIG. 14 is a perspective view of the inventive borehole pulsed jetting mining operation illustrating relative positions of downhole components and surface mining equipment and apparatus that support the borehole mining operation.

In another important aspect and referring to FIG. 14, when the combined energy from at least one pressurizing water pump 45 with the sonic drill head 38 is in fluidic communication with the bore of the sonic pulsed jetting system S, the pulsing energy transferred by interfacing to the high-pressure liquid column 22 is propagated as pulsed jets through convergent jetting nozzles 23 (of the sub-coupling 13), jetting nozzles 24 (of the shoe rock bit 12), pulsed jetting nozzles 25 (of the eductor coupling 16) to generate a repetitive pulsing hydraulic jetting effect. The effect and efficiency of the combination of high-pressure, high-volume fluid flow in combination with the harmonics and vibration created with the sonic drill head 38 that creates hydraulic pulses through the convergent jetting nozzles 23, 24 25 has been tested and proven through experimentation by the inventors.

Figure 15:
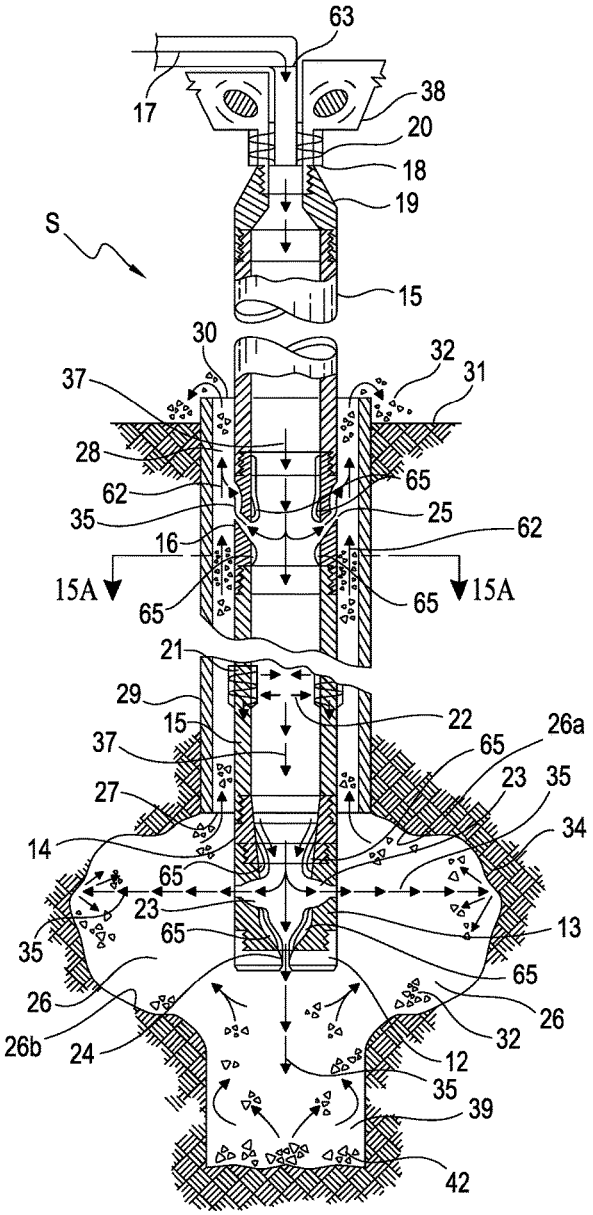
FIG. 15 is a partial sectional side view of the inventive sonically pulsed apparatus for sonically jet mining a subsurface mineral site, including optional guidevanes and fluid flow for jetting excavation and simultaneous jetting eductor coupling extraction functions.
Figure 15A:
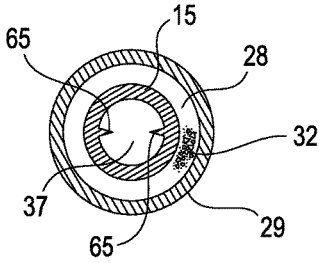
FIG. 15A is a sectional view taken along line 15A-15A of FIG. 15.

FIG. 15 is a partial sectional side view of the inventive sonic pulsed jetting system in a subsurface mineral site, including fluid flow for jetting excavation and simultaneous jetting eductor coupling extraction functions. FIG. 15 is identical to FIG. 1 except in FIG. 15, optional guidevanes 65 are included in the eductor coupling 16, in the transition rod 14, in the sub-coupling 13 and in the rock bit 12. The s 65 reduce turbulence and generate significant jet impact fluxes for optimal rock breakage and disaggregation of target minerals.

Example of Transformation of Existing Sonic Drilling System into Low-Frequency Sonic Pulsed and Hydraulic Mining System With the inventive system and method an industrial well-proven sonic drill head and sonic drilling rig such as the Terra Sonic International TSi 150CC can be used in conjunction with a water reservoir, a high-pressure energy pumping member (e.g. Gould's model 3393 pump) that are in fluidic communication using high pressure conduits, check valves and sonic rods to the inventive pulsed jetting apparatus S. These are only examples of appropriate standard equipment known to the mining industry in prior art that can be used, not to be considered to limit the scope of this invention in the present or future, with the inventive pulsed jetting mining system S and method. The example sonic drilling equipment, or generally similar equipment, is required to supply adequate water volume and pressure to pass through the sonic drill head 38, through its spindle, attached to a sonic rod 15 or sonic rod string 15*a* to which is attached to the additional components of sonic pulsed jetting system S as more fully described above. Usually in the sonic drill head 38 there is at least one rotating eccentric mass mounted and mechanically activated in an inner housing to generate acoustic or vibrational energy waves, usually sinusoidal, that are propagated as energy wave pulses to the traversing conduit and attached tubular spindle and into the rod string 15*a* and throughout the inventive pulsed jetting apparatus S. Such energy wave propagation is prevented from returning through the contained water column 37 to the high-pressure water pump 45 by one or more check valves 46 in the high pressure fluid conduit 44 between the water pump 45 and the sonic drill head 38. Rotational and wave energy from the sonic drill head 38 is imparted to the spindle that is attached to the sonic rod 15 and the sonic rod string 15*a* with vibrations of the rotating eccentric mass being usually isolated from an outer housing of the sonic drill head 38, protecting the drill tower 43 and drill rig (See FIG. 14) from inordinate vibration and from dampening the energy transfer to the sonic rod string 15*a* and to the other components of the inventive pulsed jetting apparatus S.

Experiment Performed

The inventors conducted an experiment, with the assistance Terra Sonic International, a sonic core drilling rig manufacturer in O.H., to evaluate the effectiveness of applicant's invention. The experiment demonstrated how energy waves that are propagated through a low-pressure water column as a semi-discrete to discrete pulsating stream of water moving through an elastic metal sonic drill rod attached at its top end by adaptor to a sonic rig's activated sonic drill head that oscillates at approximately 150 Hz, exit from the sonic rod's bottom end with pulsed, harmonic energy. The experiment provided strong evidence and support for the efficiency and effectiveness of the inventive system and method.

Aspects of the Inventive Method

FIG. 8 through FIG. 14, illustrate a sequence of steps in an aspect of the inventive method using the inventive pulsed jetting system S described above.

Figure 8:
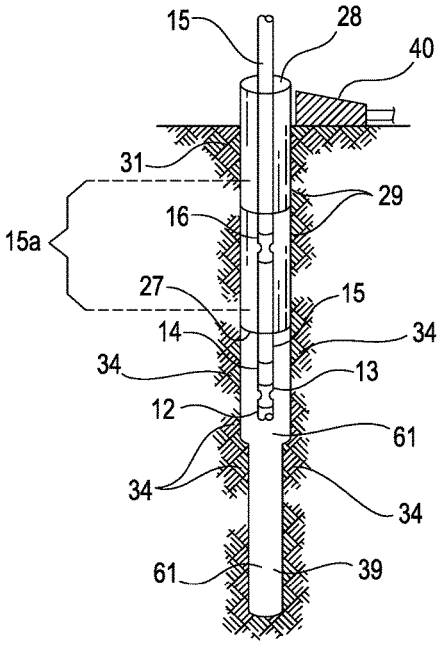
FIG. 8 is a side view of the inventive pulsed jetting mining apparatus assembly in a borehole before sonic pulsed jetting mining begins.

FIG. 8 depicts the beginning stage of pulsed jetting mining with preparation of a site for mining. At a chosen mining site where a valuable mineral deposit 34 has been discovered, a borehole has been drilled into ground 31 with a two casing 29 member string being emplaced so that the bottom end 27 of the casing 29 is just above a mineral target 34 with uncased borehole 61 being deeper than the cased borehole. The downhole components of the sonic pulsed jetting system S have been assembled and attached to a sonic drill rod string 15*a* comprised of multiple sonic rods 15, including a pulsed jetting eductor coupling 16, attached between two sonic rods 15. Normally, an eductor coupling 16 is threaded in place between consecutive sonic rods 15 to provide the desired lift in the annulus 28. The eductor coupling 16 is included and shown in hidden lines within the casing string 29 in the illustration. The sonic rod string 15*a* is attached on its bottom end to a transition rod 14, pulsed jetting sub-coupling 13 and a pulsed shoe rock bit 12. Also attached, but not shown, at the top end of the sonic rod string 15*a* is a sonic drill head 38 that is in communication with a high pressure water pump 45. The sonic rod string 15*a* and inventive pulsed jetting components have been inserted into and through the casing 29 and are in position to start mining. The annulus 28 and the slurry catch box 40 are empty because no water or other fluid has been introduced into the borehole.

Figure 9:
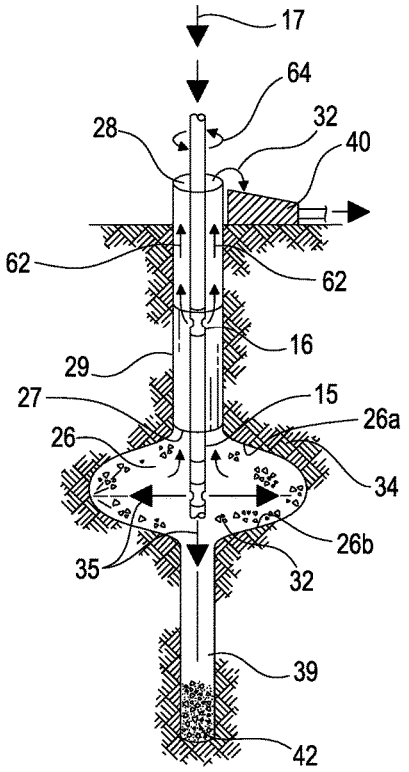
FIG. 9 is a side view of the inventive pulsed jetting mining apparatus assembly with an attached eductor coupling as shown in FIG. 8 but at a later time having started mining excavation with sonic jet pulsing and slurry recovery.

Further aspects of the invention are illustrated in FIG. 9, but at a later stage. The pulsed jetting mining process has started; it is a dynamic process as compared to the point in time as illustrated in FIG. 8. Pressurized water or other fluid 17 is being pumped into the mining site 26 through the sonic rod string 15*a* and the sonic rod string 15*a* and the other downhole components of the pulsed jetting mining system S is being rotated 64 and moved to generate maximum slurry production by the pulsed jetting mining system S, as monitored in part by the density of slurry 32 exiting the annulus 28 at the slurry catch box 40. The mining cavity 26 has begun to expand. The pulsed jetting nozzles 23 and 24 of the sub-coupling 13 and shoe rock bit 12; respectively, are fracturing and disaggregating mineral 34, agitating the slurry 32 and the concentrated heavy slurry 42 in the sump 39. The pulsed jetting nozzle 25 of the single pulsed jetting eductor coupling 16 within the two section casing string 29 is facilitating moving slurry 32 to the slurry catch box 40.

Figure 10:
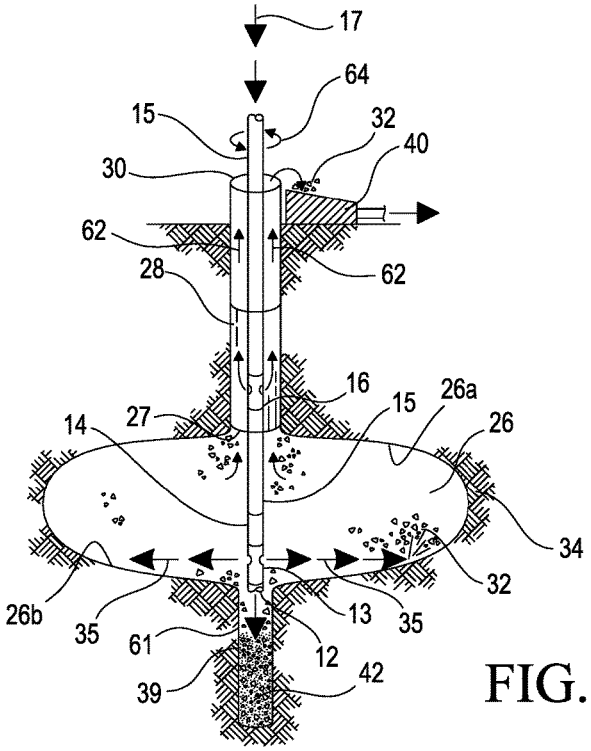
FIG. 10 is a side view of the inventive pulsed jetting mining apparatus with an attached eductor coupling as shown in FIG. 9 but at a later time, after mining for a significant time.

FIG. 10 illustrates aspects of the inventive method and depicts subterranean pulsed jetting mining of a target deposit 34, in a later stage of subsurface pulsed jetting mining than depicted in FIG. 9. FIG. 10 depicts using the same components as are described in FIG. 9, using pressurized sonically pulsed fluid 17, except the mining cavity 26 has been enlarged using the sonic drill rig to direct movements of the downhole components of the pulsed jetting mining system S, including rotation 64, pulsed jetting 35 and other sonically pulsed mining functions resulting in slurry 32 excavation and recovery, resulting in the extraction of a significant volume of targeted mineral 34 through the annulus 28 facilitated by an attached pulsed jetting eductor coupling 16 with a mining cavity 26 forming into a general spherical shape as slurry 32 is progressively moved into and through the slurry catch box 40 and then to the processing plant or storage (best seen in FIG. 14). At approximately this stage of pulsed jetting mining the pulsed jetting process is halted for collection of the sump concentrate 42, in a remnant of the original borehole 61, also referred to as a sump member 39, with sump concentrate 42 to be recovered as illustrated in FIG. 11.

Figure 11:
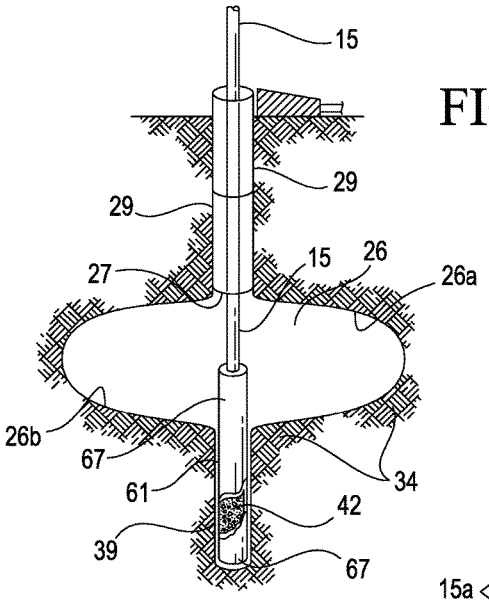
FIG. 11 is a side view of the mining site as shown in FIG. 10 at a later time, with a sonic core barrel now inserted into the mining site sump to extract heavy particulates not extracted by the inventive eductor coupling.

FIG. 11 illustrates further aspects of the inventive method depicting subterranean pulsed jetting mining of a target deposit 34, in a later stage of subsurface pulsed jetting mining than depicted in FIG. 10. The uncased borehole 61, also referred to as the sump member 39, positioned in alignment and at a distance beneath the bottom end 27 of the casing 29, has filled during sonically pulsed jetting mining with heavy concentrate 42 resulting in the sump 39 containing a significant amount of heavy slurry concentrate 42, that requires extraction. With the downhole components of the sonic pulsed mining system S removed from the mining site cavity 26 and detached from the sonic drill head 38, a core barrel 67 and attachments are adaptably connected to the sonic drill head 38 and inserted into and through the two (or more) sections of casing 29 borehole to the deeper sump member 39 to remove the sump slurry concentrate 42, as seen through a cut out section of core barrel 67, while extending the sump member 39 deeper for further site mineral sample inspection and also to obtain a plug to minimize loss of any heavy concentrate with extraction of the sump slurry concentrate 42 to the surface. With recovery of the sump slurry concentrate 42 and sample for analysis it can be determined whether to continue mining deeper.

Figure 12:
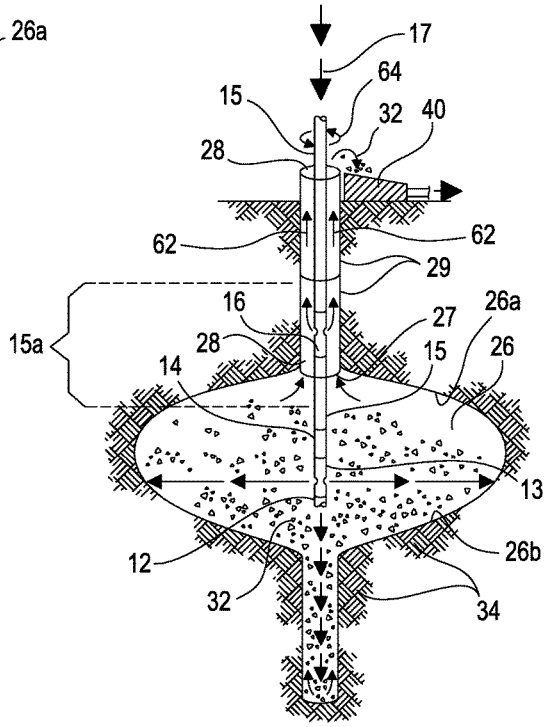
FIG. 12 is a side view with the inventive pulsed jetting mining apparatus reinserted into the mining site as shown in FIG. 9 but at a later time than FIG. 11, and with a mining cavity that can develop slurry density layering.

FIG. 12 illustrates further aspects of the inventive method depicting subterranean pulsed jetting mining using oscillating pressurized liquid 17 of a target deposit 34, in a later stage of subsurface pulsed jetting mining than depicted in FIG. 11. In FIG. 12 the same equipment and tooling are reintroduced to the target mineral site 34 to resume mining as illustrated in FIG. 9. Pulsed jetting mining can be resumed. However, after generating a certain variable distance from ceiling 26*a* to floor 26*b* in the excavated mining cavity 26, the slurry 32 becomes less dense towards the ceiling 26*a* and is not lifted efficiently into the bottom end of the casing 27 where slurry 32 is lifted into the annulus 28 where it can be directly influenced by the siphoning effect of the eductors E on the pulsed jetting eductor couplings 16 in the annulus 28 to lift the slurry to the slurry catch box 40 on the surface. The distance that produces density layering will be dependent on a variety of factors and the single borehole recovery system and recovery will become less efficient when high slurry density cannot be maintained toward the cavity's 26 ceiling 26*a*. This situation is remedied with the inventive sonically pulsed jetting system and method as illustrated in FIG. 13.

Figure 13:
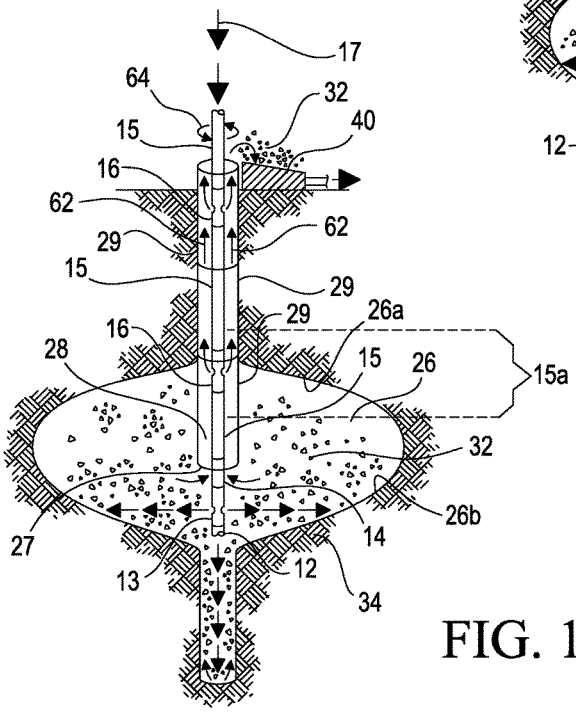
FIG. 13 is a side view of innovative method with modification of inventive pulsed jetting mining apparatus as shown in FIG. 12 but at a later time showing an efficient alternative embodiment using pulsed jetting mining with deep mining cavities and slurry density layering.

FIG. 13, illustrates further aspects of the inventive pulsed jetting method. After determining that slurry 32 density is layering away from the bottom of the casing 27 (i.e. the slurry 32 is less dense at the cavity ceiling 26*a* than at the cavity floor 26*b*), less recovery and production of slurry 32 with pressurized water 17 can occur as discussed in connection with FIG. 12. In the case of slurry 32 density gradient concentrating lower in the mining cavity 26 toward the cavity floor 26*b* with a fully filled hydraulic mining site, one aspect of the inventive method to maintain high production from a single borehole mining operation is to extend additional lengths of casing 29. This technique is known to be done by the core drilling industry for traversing cavern spaces to obtain sonic core samples, but the technique has not been used with subsurface borehole mining. Also, additional pulsed jetting eductor couplings 16 can be added with additional casing 29 sections to more efficiently move slurry 32 through the annulus 28. Frictional factors at the boundary flow layer at the inner surface of the casing 29 and the outer surface of the rod string 15*a* within the annulus 28 can also generate density layering in the annulus 28, which periodic pulsed jetting eductor couplings 16 can resolve and overcome. In FIG. 13 an additional section of casing 29 has been added and an additional pulsed jetting eductor coupling 16 has been added, placing the annulus 28 into a deeper position in the excavation cavity 26, closer to the pulsed jetting sub-coupling 13 and pulsed jetting shoe rock bit 12, with a higher slurry 32 density layer increasing the siphoning benefit through the lengthened annulus 28 to recover slurry 32 at a faster rate in the slurry catch box 40.

FIG. 14 shows a side-view with subsurface cutout and surface perspective, schematically illustrating one of many envisioned working pulsed jetting borehole mining sites with equipment performing the subsurface pulsed jetting mining process in a generally closed water cycle method, and all the while conserving water. Several large mobile equipment members work together, comprising the sonic core drilling rig 58 on a power-tracked transport, a water reservoir 55 on track-driven transport and a slurry processing plant 57 on a tracked trailer. A sonic rod string 15*a* is supported and rotated 64 by a sonic drill rig 58 that is pulsed jetting mining a subsurface mineral deposit 34 and creating a subsurface mining cavity 26 on the bottom end 27 of casing 27 in a borehole. The casing 29 was emplaced prior to mining using the sonic core drill rig's 58 tooling into an identified valuable mineral deposit 34. In direct association with the top most edge of the casing 30 is a slurry catch box 40 that catches slurry 32 as it exits the annulus 28 which is then pumped by high-volume slurry pump 48 by conduit 49 with an optional accessory pump to the slurry box 50 at the processing platform 57, where slurry is separated into gangue 60, valuable material and water. A trommel or scrubber is not needed since the subterranean slurry-making process using high-pressure turbulence and pulsed jetting and as such provides such a processing step before slurry is collected on the surface. Valuable materials in this illustration are separated by common methods such as screens, sluice, jigs and gravity concentrator. Water can be clarified by screens and hydrocyclone 53, collected in a cistern 56 and circulated back to the clarified water reservoir 55 for recycled jet mining use. Also attached to the casing's top end is an attachable collar 30 which is attached to a water level sensor 41*a* with pump actuator 41 and an attached conduit 51 which is in communication with high-volume pump 52 to a water reservoir 59 to provide hydrostatic level backup. A check valve is included in conduit 51 to prevent fluid from reversing flow direction from the annulus 28 toward the water reservoir 59. Also illustrated is a high-pressure/high-volume water pump 45 connecting the water reservoir 55 by conduit 44, having a check valve 46 and pressure release valve 47, connecting to the water swivel 63 on the drill rig's 58 sonic head 38 transferring water to the sonic drill head 38 through its spindle to the sonic rod connecting adapter 19. High-pressure, high-volume water and oscillating wave energy 21 is passed into the upper-most rod 15 in the rod string 15*a*, with connecting adapter 19. On the very bottom end of the rod string 15*a* (comprising multiple sonic rods 15 as shown in FIG. 8) and attached pulsed jetting assembly in the expanding mining cavity 26 is an attached a water pulsed jetting shoe rock bit 12, which emits jetting pulsed streams 35 into a sump member 39 collecting heavy concentrate 42, which is a diminished remnant of the original borehole and will be re-cored and the heavy valuable concentrate will be collected as part of the inventive extraction process, periodically recovering a core sample from the sump member 39 using a core barrel 67 (See FIG. 11) as an aspect of the inventive recovery method. Just above the threadably attached shoe rock bit 12 is a high-pressure laterally pulsing and rotating water jetting sub-coupling 13, which in this illustration is emitting two oppositely pulsed jetting streams 35 to fracture mineral matrix 34 into slurry 32 in an expanding subterranean cavity 26, then a transition rod 14, then sonic rods 15 interconnected by a sonic pulsed jetting eductor coupling 16 , shown in a cutout section of the casing pulsing water to lift slurry 32 up within the annulus 28 passing between the rod string 15*a* and the casing 29. The inventive system and method facilitate slurry 32 movement upwardly within the annulus 28 with hydraulic gradient forces, and further upward to a slurry catch box 40 that is in fluid continuity with the slurry box 50 at the processing plant 57. Also illustrated are arrows showing a contiguous fluid flow, starting with an arrow 17 at a pump 45 near the water reservoir 55, water moves through the swivel head 63 on the sonic rig's 58 elevated tower 43 through the sonic drill head 38 and sonic rod adapter 19 and then into the sonic rod string's 15*a* subsurface pulsed jetting process where it facilitates slurry siphon extraction with pulsed jetting from one or more sonically pulsed jetting eductor couplings 16 and simultaneously generates pulsed jets 35 to degrade mineral target material 34. Water mixes with gravel as slurry 32, which is lifted to the surface to be pumped with pump 48 to the processing plant 57, where water is separated and clarified using various methods, including hydrocyclones 53, collected in a cistern 56 and collapsible water reservoir 59 then pumped back in conduit 54 to the main water reservoir 55. One or more collapsible water reservoirs 59 can be used for water containment that can also be employed with use of additional hydrocyclones 53. A high-flow water conduit 51 with a check valve 46 attached to a water pump 52 and collapsible water reservoir 59 with fluidic continuity to casing collar 30, actuated by a collar sensor to pump water into the annulus 28 to help maintain the desirable hydrostatic level to the top of the casing 29 at the casing collar 30. The control of the proper hydrostatic level to the top of the casing 29 at the casing collar 30 facilitates eductor coupling 16 function within the annulus 28 and prevents the possibility of a subsurface excavated cavity 26 subsidence event. Once the process of pulsed jetting mining is complete the gangue 60 can be reinserted into the subterranean excavated cavity 26 to preserve the environment and to maintain safety.

Thus specific embodiments of improving an existing sonic drilling system to transform it into a highly efficient, low-frequency pulsing sonic and hydraulic mining system and different method aspects have been disclosed. It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. An enhanced method for borehole mining, separating and extracting heavy and light minerals, gems and metals from a target deposit comprising the steps of:

a. drilling a borehole using a low-frequency pulsing sonic and hydraulic mining system including a downhole pulsed jetting assembly;

b. inserting at least one length of borehole casing having an inner surface into the borehole above depth of the target deposit;

c. inserting and rotating said downhole pulsed jetting assembly into said borehole casing with a sub-coupling and a pulsed jetting shoe rock bit both positioned below said borehole casing;

d. pumping fluid into the borehole;

e. monitoring light slurry at surface of the borehole and evaluating content of light slurry and density of the light slurry;

f. fracturing, agitating and disaggregating materials at the target deposit with pulsed jets from pulsed jetting nozzles in said sub-coupling and with pulsed jets from pulsed jetting nozzles in said pulsed jetting shoe rock bit causing light slurry to flow upwardly to an annulus formed between the inner surface of said borehole casing and outside of said downhole pulsed jet assembly, then upwardly through said annulus to the surface of the borehole thereby causing heavy slurry to concentrate in a sump, said sump being located below said pulsed jetting shoe rock bit;

g. continuing to fracture, agitate and disaggregate materials according to step f to form a cavity at the target deposit;

h. removing said downhole pulsed jetting assembly from the borehole and running a core barrel to extract heavy slurry that is concentrated in said sump;

i. analyzing the heavy slurry and the light slurry to determine whether to repeat steps a through h.

2. A method for mining minerals, gems and metals from a target deposit according to claim 1 wherein step f also includes using a sub-coupling having pulsed jetting nozzles together with said pulsed jetting shoe rock bit.

3. A method for mining minerals, gems and metals from a target deposit according to claim 1 wherein at least one eductor coupling is positioned in said downhole pulsed jetting assembly to enhance upward flow of light slurry to the surface of the borehole.

4. A method for mining minerals, gems and metals from a target deposit according to claim 1 wherein after step g, continuing to fracture, agitate and disaggregate materials according to step f to form a generally spherical shaped cavity at the target deposit.

5. A method for mining minerals, gems and metals from a target deposit according to claim 1 including the additional step of moving light slurry from a catch box at the surface of the borehole to a processing system to separate water, minerals, gems and metals obtained from the target deposit.

6. A method for mining minerals, gems and metals from a target deposit according to claim 1 including the following additional steps after step i:

j. inserting at least one additional length of borehole casing into the borehole below ceiling of said cavity, including adding a plurality of eductor couplings into said downhole pulsed jetting assembly;

k. inserting said downhole pulsed jetting assembly into the borehole and through said borehole casing; and l. repeating steps a through i until it is determined that the target deposit does not contain sufficient target mineral to justify continuing operation.

7. A method for mining minerals, gems and metals from a target deposit according to claim 3 wherein said method includes the additional step of contacting an outer surface of at least one eductor on said at least one eductor coupling to the inner surface of said borehole casing to at least partially close the outer surface of said at least one eductor to enhance the upward vacuum of light slurry in said annulus between the inner surface of said borehole casing and the outside of said downhole pulsed jet assembly from the target deposit to the surface.

8. A method for mining minerals, gems and metals from a target deposit according to claim 1, wherein said method includes the additional step of maintaining and monitoring a substantially high hydrostatic level of the borehole and cavity to enhance eductor coupling function and light slurry hydraulic extraction and to resist cavity ceiling subsidence of said cavity.

* * * * *